US005401033A

United States Patent [19]

Lychock, Jr.

[11] Patent Number: 5,401,033

[45] Date of Patent: Mar. 28, 1995

[54] DART GAME WITH RANDOM TARGET NUMBER GENERATOR

[75] Inventor: Ferdinand P. Lychock, Jr., Roscoe, Ill.

[73] Assignee: Arachnid, Inc., Rockford, Ill.

[21] Appl. No.: 201,652

[22] Filed: Feb. 25, 1994

[51] Int. Cl.[6] ..... F41J 3/00

[52] U.S. Cl. ..... 273/371; 273/372; 273/374; 273/DIG. 26; 340/323 R

[58] Field of Search ..... 273/371–376, 273/408, DIG. 26; 340/323 R

[56] References Cited

U.S. PATENT DOCUMENTS

| | | | |
|---|---|---|---|
| 4,793,618 | 12/1988 | Tillery et al. | 273/376 |
| 4,948,148 | 8/1990 | Danielson | 273/408 |
| 4,974,857 | 12/1990 | Beall et al. | 273/371 |
| 5,020,806 | 6/1991 | Martin | 273/371 |
| 5,116,063 | 5/1992 | Harlan et al. | 273/376 |
| 5,156,643 | 10/1992 | Grubek | 273/376 |

*Primary Examiner*—V. Millin
*Assistant Examiner*—Kerry Owens
*Attorney, Agent, or Firm*—McAndrews, Held & Malloy

[57] ABSTRACT

A dart game and a method of controlling a dart game wherein numbers corresponding to targets to be aimed at by a player are randomly generated throughout the play of the game until a predetermined number of target values have become fixed by being marked by a dart hit on the dart board. Prior to the start of a game, a predetermined number of target values are randomly generated and displayed. After each player's turn, the target values that have been marked by a dart hit on a corresponding section of the dart board are fixed for the remainder of the game. However, any unmarked target value is changed to a new, randomly generated value prior to the next player's turn. The random generation of target numbers continues until the predetermined number of target values have been marked.

20 Claims, 2 Drawing Sheets

DART GAME WITH RANDOM TARGET NUMBER GENERATOR

TECHNICAL FIELD

The present invention is directed to a dart game and more particularly to a controller and method of controlling a dart game to randomly generate a set of target numbers, each corresponding to a respective bed on the dart board, during the play of the game. When a generated target number is marked by a dart hit on the corresponding bed, the target number is fixed for the remainder of the game. However, any target number that remains unmarked after a player's turn is changed to a new, randomly generated numerical value prior to the next player's turn, the random generation of target numbers continuing until a predetermined number of numerical target values are marked.

BACKGROUND OF THE INVENTION

A dart game called Cricket is known wherein players try to hit a bullseye bed and six beds on the dart board numbered 15–20. When a player scores three marks in a particular dart board bed, the player is said to have "closed" the bed. If one player successfully closes a dart board bed before another player can close the same bed, each successive mark scored in that bed by the first player to close the bed is added to that player's score. The first player to close a bed therefore increases his total score by landing dart hits in that bed until another player is able to close the bed and stop the first player from accruing more points.

Another known dart game is called Random Cricket. In the known Random Cricket game, prior to the start of the game, six target numbers are randomly generated so that the target numbers do not necessarily correspond to the numbers 15–20. The six target numbers are randomly generated only once prior to the start of the game and remain fixed throughout the play of the game. After the six numbers are randomly generated, the game is played as described above for the conventional Cricket dart board game. Thus, this known Random Cricket game does not provide any more excitement or interest than the conventional Cricket game once the play of the game is started and the target values are fixed.

SUMMARY OF THE INVENTION

In accordance with the present invention, the disadvantages of prior Cricket dart board games have been overcome. The Cricket dart board game of the present invention changes the target values to randomly generated numbers throughout the play of the game until a predetermined number of target values have become fixed by being marked by a player. Because the target values are changing while the game is being played, the dart board game of the present invention is more exciting and interesting to play than conventional Cricket or Random Cricket.

More particularly, the present invention is directed to a controller and method of controlling a dart game wherein a first set of target values is randomly generated, the first set having a predetermined number of target values therein. After each player's turn, the controller determines which of the target values have been marked and fixes the marked target values for the remainder of the game. Prior to the next player's turn, the controller randomly generates a set of new target values equal in number to the number of non-fixed target values remaining. The random generation of target numbers prior to each player's turn continues until a predetermined number of target values have been marked and therefore fixed by the controller.

These and other objects, advantages and novel features of the present invention, as well as details of an illustrative embodiment thereof, will be more fully understood from the following description and from the drawing.

DESCRIPTION OF THE PREFERRED EMBODIMENT

Figure 1:
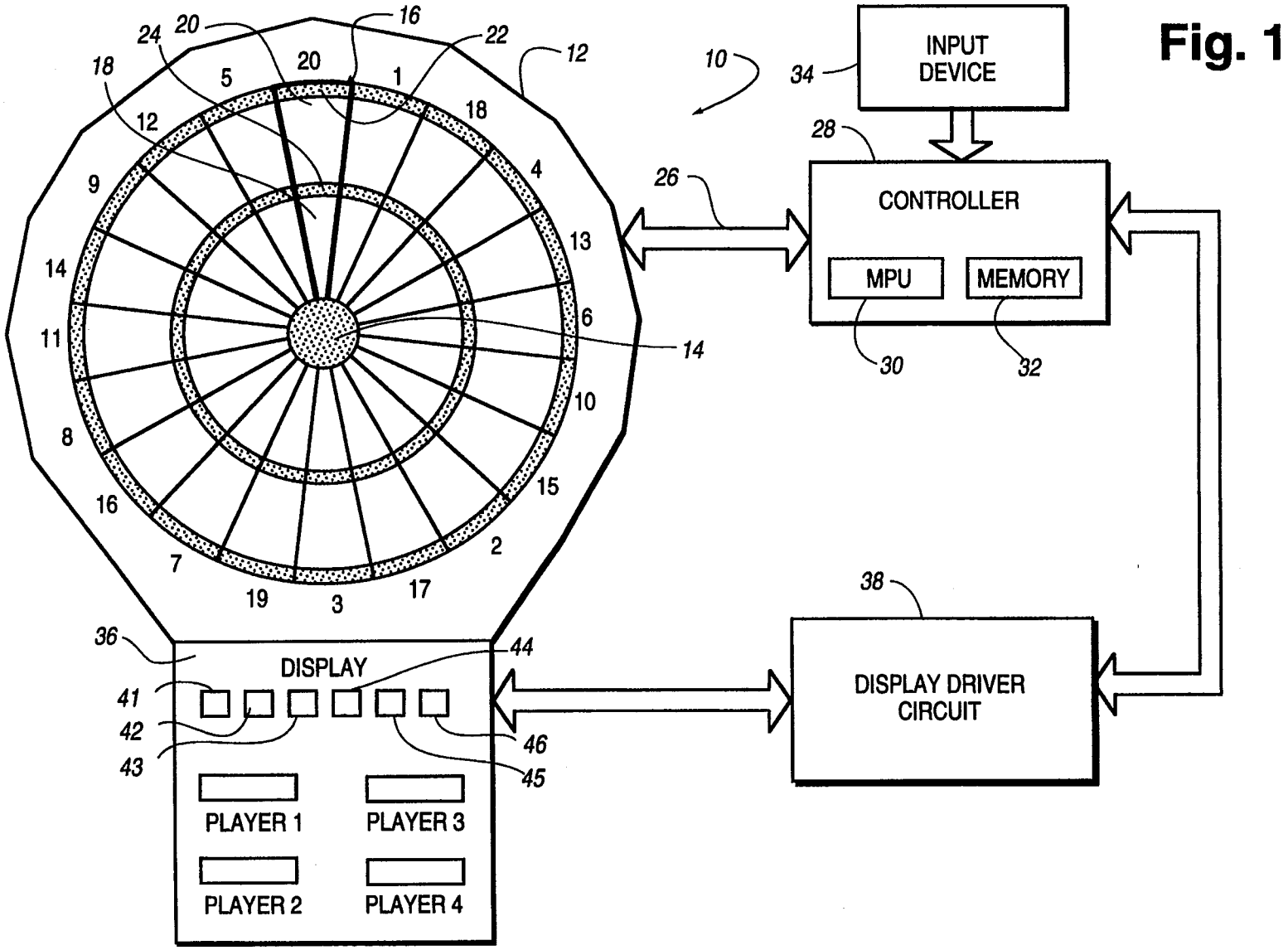
FIG. 1 is a block diagram of the dart game of the present invention.

A dart game 10 in accordance with present invention, as shown in FIG. 1 includes a dart board 12 having a number of beds corresponding to numerical target values between 1 and 20 and a bullseye bed 14. Each bed, as illustrated for the "20" target value bed 16, has four segments 18, 20, 22 and 24. If a dart thrown by a player hits either of the segments 18 or 20, it is treated as a single mark. If segment 22 is hit by a dart, it is treated as a double mark and if the segment 24 is hit, it is treated as a triple mark. A player can close a target value by, for example, hitting either of the segments 18 or 20 three times or by hitting the segment 24 once.

The dart board 12 is coupled to a controller 28 that controls the play of the game as well as scoring. The controller 28 includes a microprocessor 30 that operates in accordance with software stored in a memory 32. The memory 32 may include a non-volatile memory for storing software and may further include a random access memory that is used to store scratch pad data and the like. The controller 28 is responsive to inputs from an input device 34 which may take the form a keyboard, pushbuttons, switches etc. for signaling the start of the game and the number of players that are going to play a game. A display 36 is controlled by the controller 28 via a display driver circuit 38 so as to provide messages and scoring information to the players during a dart game.

In particular, the controller 28 controls the display 36 to display at the start of a game six randomly generated target values 41–46. When a player marks one of the displayed target values by hitting the bed corresponding to the target value on the dart board 12, the controller 28 fixes the marked target value so that it remains unchanged throughout the remainder of the game. However, after each player's turn and prior to the next player's turn, the controller 28 changes any target value that remains unmarked by randomly generating a new target value to be displayed on the display 36 in place of the old, unmarked target value. The random generation of new target values continues until six numerical target values have been marked and thus fixed. After six target values have been marked, the play of the game continues as in conventional Cricket.

During the operation of the dart game, the controller 28 scans a set of switches associated with each segment 18, 20, 22 and 24 for each target value on the dart board to determine whether a segment has been hit by a dart impact. When a dart impacts a segment, the segment moves inward to actuate its associated switch. By scanning a sensing bus 26, the controller detects the actuation of a segment switch and thus a dart hit on the segment. An example of an arrangement of segments and associated switches is described in greater detail in U. S. Pat. No. 4,057,251 incorporated herein by reference. Although movable segments associated with the switches are preferred, magnetic or other types of devices for sensing dart impacts may also be used in the dart game in accordance with the present invention. Similarly, hard-wired logic may be used in place of the microprocessor based controller 28 for monitoring the sensing bus 26.

Figure 2:
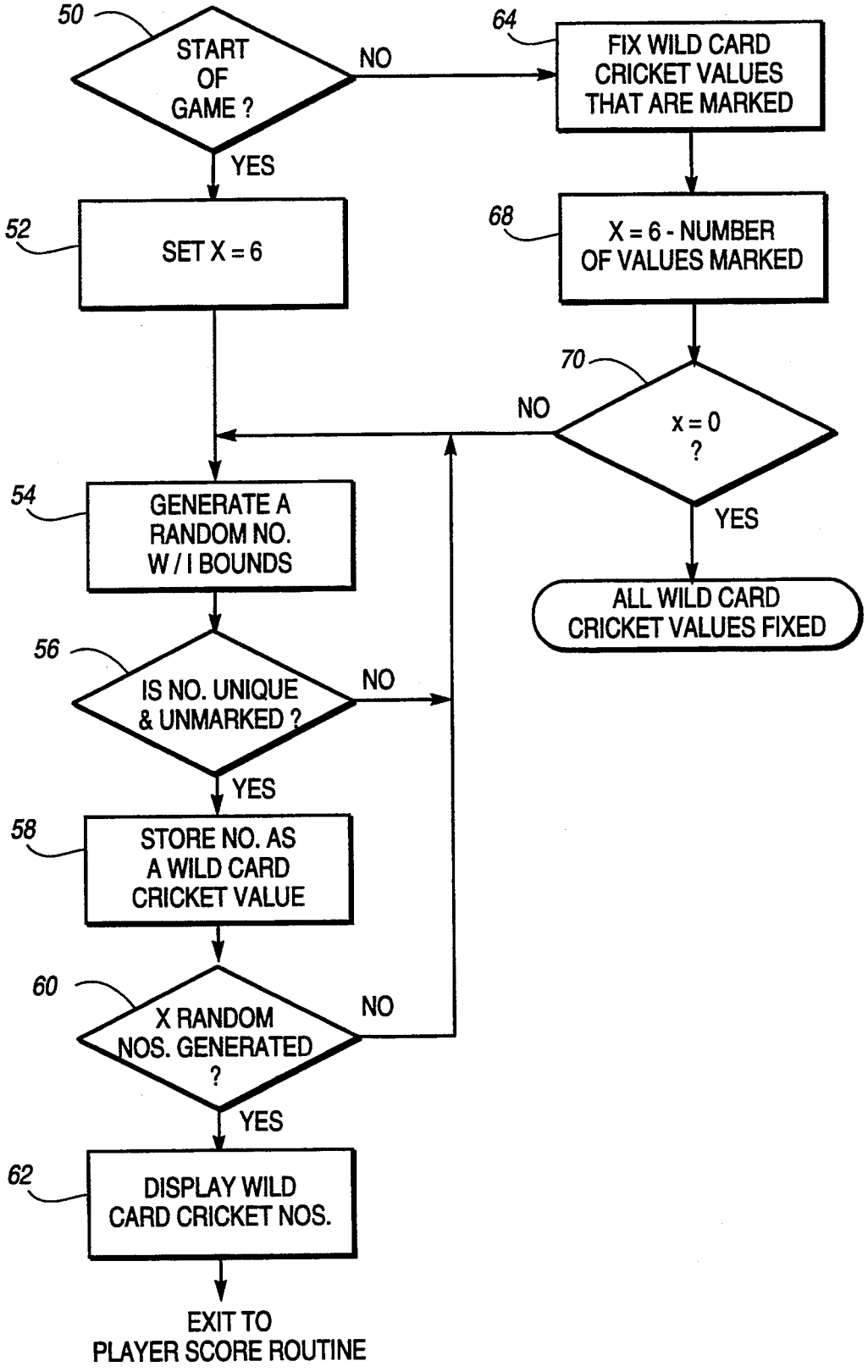
FIG. 2 is a flow chart illustrating the operation of the random target value generation scheme for the dart game of the present invention.

The controller 28 operates in accordance with the software routine depicted in FIG. 2 to control the play of the dart board game by randomly generating a set of target values for display on the display 36 prior to each player's turn until a predetermined number of target values, such as six target values, are marked. More particularly, the microprocessor 30 at block 50 determines whether the game has just started. If so, the microprocessor 30 sets a variable X equal to the number of target values to be generated for example, the number 6. Thereafter, the microprocessor 30 generates at a block 54 a random number between a low bound and a high bound. At a block 56 the microprocessor 30 determines whether the number generated at block 54 is a unique number. If the number randomly generated at block 54 is determined at block 56 to be unique, the microprocessor proceeds to block 58 to store the generated number as a Wild Card Cricket value in a Wild Card Cricket array in the memory 32. Thereafter, at a block 60 the microprocessor 30 determines whether all of the target values have been randomly generated and if not, returns to block 54. After the set of target values has been randomly generated, the microprocessor proceeds to block 62 to control the display 36 to display the generated set of target values. Thereafter, the microprocessor 30 exits to the player score routine.

In the player score routine, as described in detail in U.S. patent application Ser. No. 08/009,232 filed Jan. 26, 1993 for an Electronic Cricket Dart Game, assigned to the assignee of the present invention and incorporated herein by reference, the microprocessor 30 first scans the sensing bus 26 to determine whether a dart hit on the dart board 12 has occurred. If a dart impact or hit has occurred, the microprocessor 30 scores the marks associated with the dart hit. If one player has three marks on a particular target value, the target value is closed. Subsequent hits on the bed associated with that closed target value by that one player accrue scoring points for the player until a different player marks that same target value three times so as to close the target value. When a different player closes the target value, he stops subsequent scoring by the first player.

Prior to the next player's turn, the routine depicted in FIG. 2 is entered again. Since this is not the start of the game, the microprocessor 30 proceeds to block 64 to determine which of the target values have been marked and to fix in the memory 32 the target values that have been marked during the previous player's turn. A target value may be fixed, for example, by setting a flag or the like in the Wild Card Cricket array in association with the target value, the flag indicating that the value is fixed. Thereafter, at block 68 the microprocessor determines which and/or how many of the target values remain unmarked. If a target value remains unmarked as determined at block 70, the microprocessor 30 proceeds to block 54 to change each unmarked target value to a new randomly generated target value. In particular, for each unmarked target value in the Wild Card Cricket array, the microprocessor at block 54 generates a random number within the specified bounds and at block 56 determines if the generated number is unique and unmarked. The microprocessor checks to see whether a generated number is unique and unmarked so that a number stored in the Wild Card Cricket array and left unmarked by one player is not replaced by the same number and to ensure that six different target values are being displayed at a given time. It is noted that a variation of the dart game in accordance with the present invention might allow a number previously closed by a first and second player to be opened by the random generator if desired. At block 58 the microprocessor 30 stores the newly generated number in the memory 32, for example by replacing one of the unmarked target values therein. If the microprocessor determines at block 60 that there are more unmarked target values that need to be replaced the microprocessor returns to block 54 to replace the next target value.

After the set of new target values is generated, the microprocessor 30 displays the new target values at block 62 along with the previously fixed i.e., marked target values on the display 36 prior to the next player's turn. Thus, each player aims at a different set of target values until a predetermined number of target values i.e. six in the previous example, have been fixed or marked. When the predetermined number of target values have been fixed or marked, the play of the game continues as in conventional Cricket.

Many modification and variations of the present invention are possible in light of the above teachings. For example, although the value of the bullseye 14 has not been described as being randomly generated, the bullseye value may also be randomly generated once per game or prior to each player's turn in accordance with the teachings of the present invention. Many other modifications are also possible without departing from the above teachings. Thus, it is to be understood that within the scope of the appended claims, the invention may be practiced otherwise than as described herein above.

What is claimed and desired to be secured by Letters Patent is:

1. A method of controlling a dart game to be played by each of a plurality of players in turn, comprising:

randomly generating a first set of target values having a predetermined number of values therein;

determining after a player's turn the target values in said first set that have not been hit at least once by a dart; and generating, in response to a determination that the number of non-hit target values is greater than zero, a new set of target values, said new set including target values previously hit by a dart at least once and a number of new, randomly generated target values, the number of said new target values being equal to the number of target values that have not been previously hit.

2. A method of controlling a dart game as recited in claim 1 wherein said determining step and said new target value generating step are performed after each player's turn until the number of target values that have not been hit at least once by a dart is zero.

3. A method of controlling a dart game to be played by each of a plurality of players in turn comprising:

randomly generating a set of target values having a predetermined number of values therein;

determining after a player's turn the target values in said set that have been hit at least once by a dart;

fixing the target values determined to be hit at least once such that said target values remain unchanged during the remainder of the game;

randomly generating after a player's turn a set of new target values equal in number to the number of nonfixed target values; and displaying said new target values with said fixed target values.

4. A method of controlling a dart game as recited in claim 1 wherein said step of randomly generating a new set of target values is performed after each player's turn until the number of nonfixed target values is zero.

5. A method of controlling a dart game to be played by each of a plurality of players in turn said dart game having a dart board with a plurality of target areas each corresponding to a target value and a memory comprising:

randomly generating a first set of target values;

storing said first set of target values in said memory;

determining which of said target values has been marked by a dart hit during a player's turn; and replacing in said memory prior to a next player's turn each target value that has not been marked during any player's previous turn with a different target value.

6. A method of controlling a dart game as recited in claim 5 wherein said replacing step includes randomly generating a new number within a given range of numbers.

7. A method of controlling a dart game as recited in claim 6 wherein said replacing step includes determining whether said newly generated number has been marked.

8. A method of controlling a dart game to be played by each of a plurality of players in turn, said dart game having a dart board with a plurality of target areas each corresponding to a target value and a memory comprising:

generating a first set of target values;

storing said first set of target values in said memory;

displaying said first set of target values;

determining which of said target values has been marked by a dart hit on a corresponding target area;

generating a new target value for each value stored in said memory that has not been marked; and displaying said marked target values with said new target values.

9. A method of controlling a dart game as recited in claim 8 wherein said generating steps include randomly generating numbers within a given range of numbers.

10. A method of controlling a dart game as recited in claim 9 wherein said new target value generating step includes determining whether said newly generated number has been marked.

11. A controller for a dart game to be played by each of a plurality of players in turn, said dart game having a dart board with a plurality of target areas each corresponding to a target value, comprising:

a random number generator for generating a set of numerical target values;

means for determining which of said target values has been marked by a hit on a corresponding target area of said dart board;

means for controlling said random number generator for generating a new set of target values, said new set of target values including a replacement target value for each previously generated target value that has not been marked.

12. A controller for a dart game as recited in claim 11 wherein said means for controlling said random number generator generates a new set of target values after each player's turn until all of said target values are marked.

13. A controller for a dart game to be played by each of a plurality of players in turn, said dart game having a dart board with a plurality of target areas each corresponding to a target value, comprising:

a number generator for generating a set of numerical target values;

a memory for storing said set of numerical target values;

means for determining which of said target values has been marked by a hit on a corresponding target area of said dart board;

means for controlling said number generator for generating a new set of target values, said new set of target values including a replacement target value for each previously generated target value that has not been marked, said replacement target values being stored in said memory with said target values that have been marked.

14. A controller for a dart game as recited in claim 13 wherein said means for controlling said number generator generates a new set of target values after each player's turn until all of said target values are marked.

15. A controller for a dart game to be played by each of a plurality of players in turn, said dart game having a dart board with a plurality of target areas each corresponding to a target value, comprising:

means for generating a first set of target values, said set having a predetermined number of values therein;

means for storing said first set of target values;

means for determining which of said target values has been marked by a dart hit during a player's turn; and means for replacing in said storage means prior to a next player's turn each target value that has not been marked during any player's previous turn with a different target value.

16. A controller for a dart game as recited in claim 15 wherein said number generating means generates random numbers within a predetermined range of numbers.

17. A controller for a dart game as recited in claim 15 wherein said replacing means includes means for determining whether a newly generated number has been marked.

18. A controller for a dart game, to be played by each of a plurality of players in turn said dart game having a dart board with a plurality of target areas each corresponding to a target value, comprising:

means for generating a first set of target values;

means for storing said first set of target values;

means for displaying said first set of target values;

means for determining which of said target values has been marked by a dart hit on a corresponding target area;

means for generating a replacement target value for each target value that has not been marked, said replacement target values being displayed on said display means with said marked target values.

19. A controller for a dart game as recited in claim 18 wherein said number generating means generates random numbers within a predetermined range of numbers.

20. A controller for a dart game as recited in claim 18 wherein said replacement target value generating means generating replacement target values after each players turn until each of said values is marked.

* * * * *